US006643854B1

(12) United States Patent
Jensen

(10) Patent No.: US 6,643,854 B1
(45) Date of Patent: Nov. 11, 2003

(54) METHOD AND APPARATUS FOR UNCLOGGING A TOILET

(76) Inventor: David R. Jensen, 5679 W. 3640 S., West Valley City, UT (US) 84128

( * ) Notice: Subject to any disclaimer, the term of this patent is extended or adjusted under 35 U.S.C. 154(b) by 0 days.

(21) Appl. No.: 10/302,346

(22) Filed: Nov. 23, 2002

(51) Int. Cl.[7] ..... E03D 9/00
(52) U.S. Cl. ..... 4/255.01
(58) Field of Search ..... 4/255.01–255.03, 4/255.06, 255.11, 255.12

(56) References Cited

U.S. PATENT DOCUMENTS 2,529,587 A * 11/1950 Bates et al. ..... 4/255.01
5,600,856 A 2/1997 Kang
5,768,719 A 6/1998 Harvey
5,852,834 A 12/1998 Harvey
5,963,994 A * 10/1999 Harvey ..... 4/253

* cited by examiner

*Primary Examiner*—Gregory Huson
*Assistant Examiner*—Huyen Le

(57) ABSTRACT

Improved apparatus for unclogging a toilet. The apparatus includes a resilient sealing ring shaped generally to conform to the shape of the rim of a toilet, a support plate attached to said sealing ring configured such that a force exerted on the support plate is transmitted to the sealing ring to compress the sealing ring against the rim of the toilet forming a substantially airtight seal around the toilet bowl. The apparatus further includes a sealing device insertable into the toilet tank including a sealing surface configured to form a substantially air tight seal over the vent tube, said sealing device further including a member configured to mechanically block the operation of the valve such that air is substantially prevented from escaping from the bowl through the tank when the sealing ring is compressed.

13 Claims, 10 Drawing Sheets

METHOD AND APPARATUS FOR UNCLOGGING A TOILET

BACKGROUND OF THE INVENTION

1. Field of the Invention

This invention relates to an apparatus and method for unclogging a toilet, and more particularly, to an apparatus and method for using air pressure to dislodge the clog.

2. Description of the Related Art

The use of a device to push through or to dislodge a blockage to unclog a toilet has been generally known. Most of these devices have included a pump end that must be inserted into the toilet bowl and a long plunger handle used by the person to exert a downward force onto the pump end. Such a device is generally known as a "plumber's helper." Other, equally undesirable solutions to unclogging toilets include pouring water from a bucket into the toilet bowl, and waiting for the waste and paper to "soften up" so that the pressure within the bowl eventually flushes through the drainage system However, the methods for unclogging toilets are neither modern, efficient nor desirable.

The use of a plumber's helper is often associated with two problems. The first problem is that the use of a plumber's helper often splashes water or waste material from the toilet bowl. The second problem is that the use of a plumber's helper is often difficult as the pump attached at the end of the plunger handle fails to provide a good seal between the pump and the water outlet near the bottom of the toilet bowl. Also, in order to be practical, the plumber's helper must reside adjacent to the toilet, which is unsightly and creates sanitary issues, as the plumber's helper must be cleaned after use in a toilet bowl with waste material in it.

The problem of splashing water has been dealt with by providing a cover or a shield with a small hole therein to prevent the water and waste material from spilling over the toilet bowl. The use of the shield reduces the spilling and the splashing of the liquid, but the handle portion of the plumbers helper must be manipulated through the small hole making the formation of a good seal around the water outlet near the bottom of the toilet bowl even more difficult. Moreover, the use of the shield did not allow the user to see the pump portion of the plumber's helper, requiring blind operation underneath the shield, which often made the use very time consuming and inefficient. Furthermore, the plumber's helper still needed to be cleaned.

SUMMARY OF THE INVENTION

In one embodiment, the invention is apparatus for unclogging a toilet for use with a toilet being of the type having a bowl for containing flushable water therein, the bowl having a rim that is higher than the surface of the water with the bowl, and a tank in fluid communication with the bowl for storing a flushing supply of water, the tank having a valve mechanism for stopping the flow of water from the tank to the bowl until operated and a vent tube. The apparatus includes a resilient sealing ring shaped generally to conform to the shape of the rim of the toilet, a support plate attached to said sealing ring configured such that a force exerted on the support plate is transmitted to the sealing ring to compress the sealing ring against the rim of the toilet forming a substantially airtight seal around the bowl. The apparatus further includes a sealing device insertable into the tank including a sealing surface configured to form a substantially air tight seal over the vent tube, said sealing device further including a member configured to mechanically block the operation of the valve such that air is substantially prevented from escaping from the bowl through the tank when the sealing ring is compressed.

In an alternate embodiment, the invention is a sealing device for use with apparatus for unclogging a toilet for use with a toilet being of the type having a bowl for containing flushable water therein, the bowl having a rim that is higher than the surface of the water with the bowl, and a tank in fluid communication with the bowl for storing a flushing supply of water, the tank having a valve mechanism for stopping the flow of water from the tank to the bowl until operated and a vent tube. The sealing device is insertable into the tank and includes a sealing surface configured to form a substantially air tight seal over the vent tube, said sealing device further including a member configured to mechanically block the operation of the valve such that air is substantially prevented from escaping from the bowl through the tank when the apparatus compresses air against the water in the bowl.

BRIEF DESCRIPTION OF THE DRAWINGS

These and other objects and features of the present invention will become more fully apparent from the following description and appended claims taken in conjunction with the following drawings, where like reference numbers indicate identical or functionally similar elements.

DETAILED DESCRIPTION OF THE INVENTION

The following presents a detailed description of embodiments of the invention. However, the invention can be embodied in a multitude of different ways as defined and covered by the claims. The invention is more general than the embodiments that are explicitly described, and is not limited by the specific embodiments.

Figure 1:
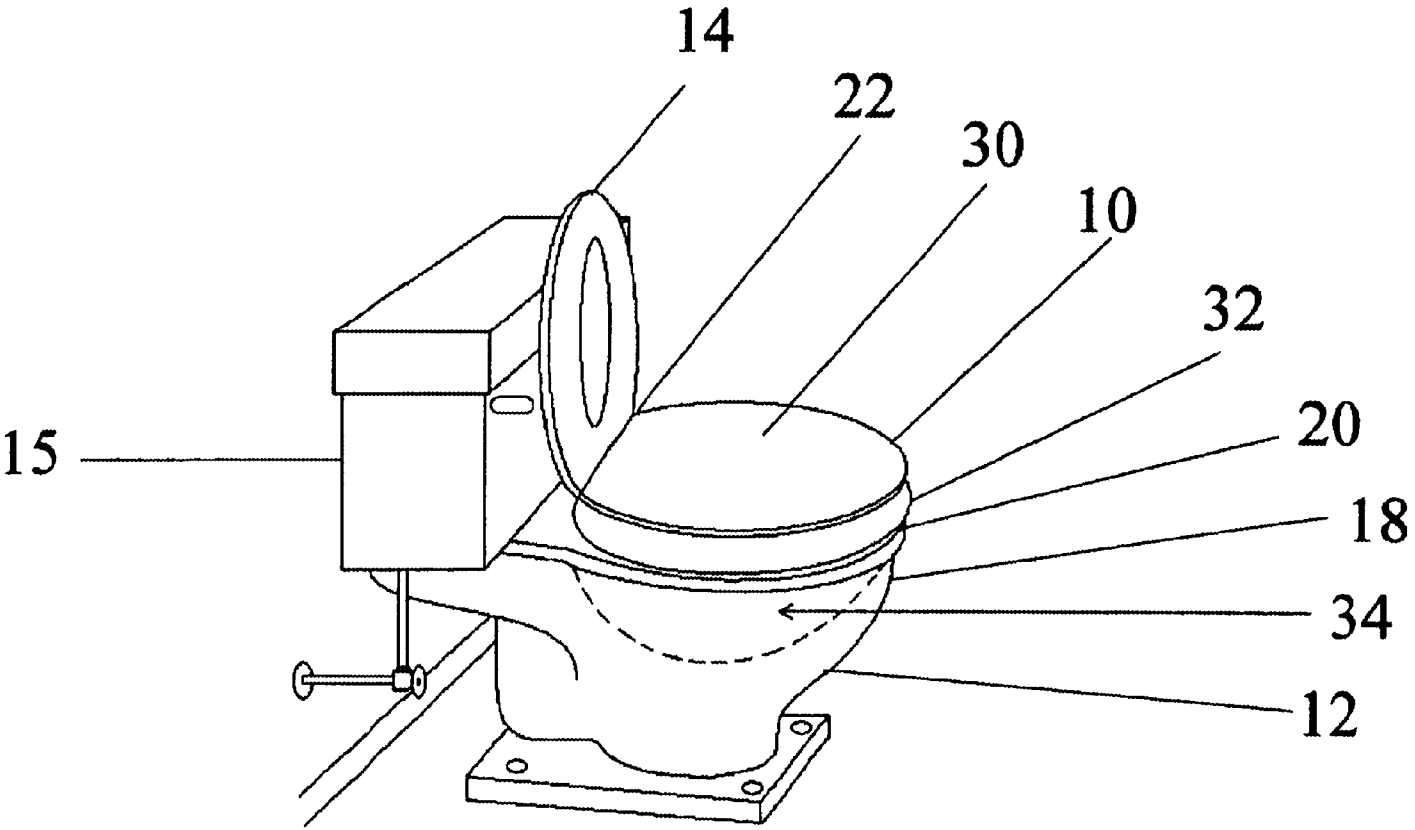
FIG. 1 is a perspective view of a toilet with a pump assembly according to an embodiment of the invention.

FIG. 1 illustrates an embodiment of clog removing system 10 used for dislodging clogs in a toilet system 12. Preferably, the clog removing system 10 is removable from the toilet 12 such that it can be placed on the toilet 12 when the toilet becomes clogged and removed from the toilet 12 and stored when the clog has been dislodged. Generally, the toilet 12 is like toilets known in the prior art. Specifically, the toilet 12 includes seat 14, a water storage tank 16 and a bowl 18. The bowl 18 has a rim 20 that is higher than the surface of the water contained within the bowl 18. The water within the bowl 18 is used to flush waste and other products down into the sewer system. A hinge 22 connects the seat 14 to the bowl 18 so that the seat 14 is moveable between a raised position and a lowered position in which the seat 14 is down and adjacent to the rim 20.

The clog removing system 10 includes a support plate 30 connected to a sealing ring 32. Preferably, the sealing ring 32 is placed on the rim 20 of the toilet 12 when the seat 14 is in a raised position In one embodiment, the sealing ring 32 has generally a doughnut shape and is of a size to conform to the shape and size of a common toilet bowl rim. It is desirable that the sealing ring 32 has sufficient girth that it may be used with different sizes and shapes of toilet bowls 18. Preferably, the sealing ring 32 has a thickness between 0.5 and 4.0 inches, more preferably between 0.75 and 3 inches and even more preferably between 1.0 and 2.0 inches. The sealing ring 32 is made of a generally soft, resilient material such as a soft rubber. Other materials, such a closed cell foam, an air filed inner tube and the like can also be used for the sealing ring 32.

The support plate 30 provides support for the sealing ring 32. As shown, the support plate 30 is shaped substantially like a disc so that it conforms to the shape of the sealing ring 34. In one embodiment, the support plate 30 is made of a substantially rigid material so that a user can push down on the support plate 30. Suitable materials for the support plate 30 include fiberglass, plastic and composite materials, which are durable and selectively rigid, depending upon material thickness. The support plate 30 can be of a transparent or opaque material and can have a surface on which instructions, figures, or other descriptive material may be printed thereon.

Figure 2:
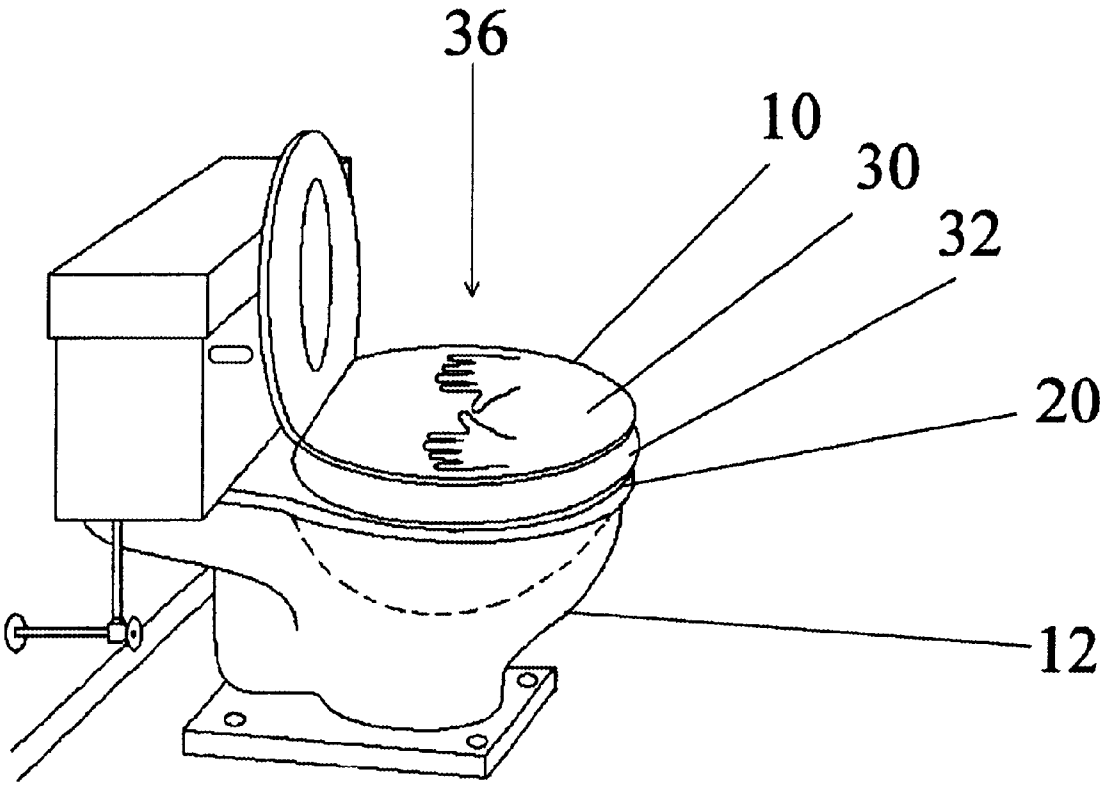
FIG. 2 is a perspective use of the pump assembly of FIG. 1 in use.

When in use, the sealing ring 32 is placed on the rim 20 of the toilet 12 so that a controlled air volume 34 is formed between the water surface in the bowl 18 and the sealing ring 32 and support plate 30. When a force is exerted on the support plate 30, shown illustratively in the direction of arrow 36 of FIG. 2, the force is transmitted from the support plate 30 to compress the sealing ring 32 against the rim 20. By pressing the sealing ring 32 against the rim, the sealing ring 32 compresses and seals against the rim 20, forming a substantially airtight seal to seal the air volume 34. By pressing even further on the support plate 30, the sealing ring 32 compresses, causing the air volume 34 to change. By removing the pressing force, the sealing ring 32 returns substantially to its uncompressed state. Repeated forcing of the support plate 30 in a downward direction and allowing the sealing ring to expand back to its pre compressed state creates a force on the surface of the water in the bowl 18 that forces the clog through the restricted area, thus clearing the clog. While the support plate 30 should be sufficiently rigid so that an operator may exert a force on the support plate 30, in one embodiment, it is preferable that the support plate be flexible so that a spring-like force is created on the sealing ring 32 during use.

Figure 3:
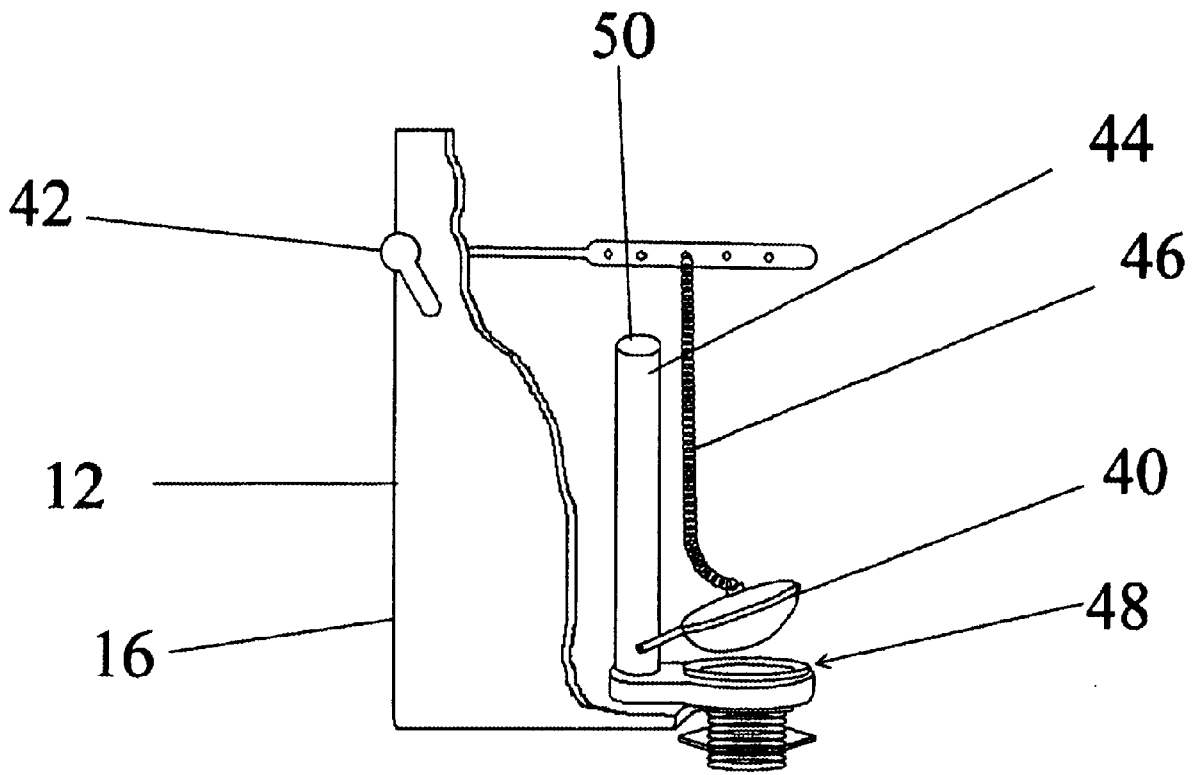
Figure 3 (Prior Art)
FIG. 3 is a partial cutaway view of a prior art toilet tank with a vent tube and flapper valve.

FIG. 3 illustrates an interior portion of the tank 16. As in known in the art, the toilet 12 has a flapper valve 40 mechanically connected to a handle 42 positioned on the exterior of the tank 16. When the handle 42 is depressed, a chain 46 or other connecting member lifts the flapper valve 40 exposing an orifice 48 that through which the flushing volume of water stored in the tank 16 is directed to the toilet bowl 18. The toilet also has a vent tube 44 configured to prevent the water level in the tank from overflowing during a malfunction of the toilet filling system. The vent tube 44 has an opening 50 in an upper portion 52 configured above the normal surface level of the water level in the tank 16 through which an overflow of flushing water in the tank 16 can be directed to the toilet bowl 18.

Figure 4:
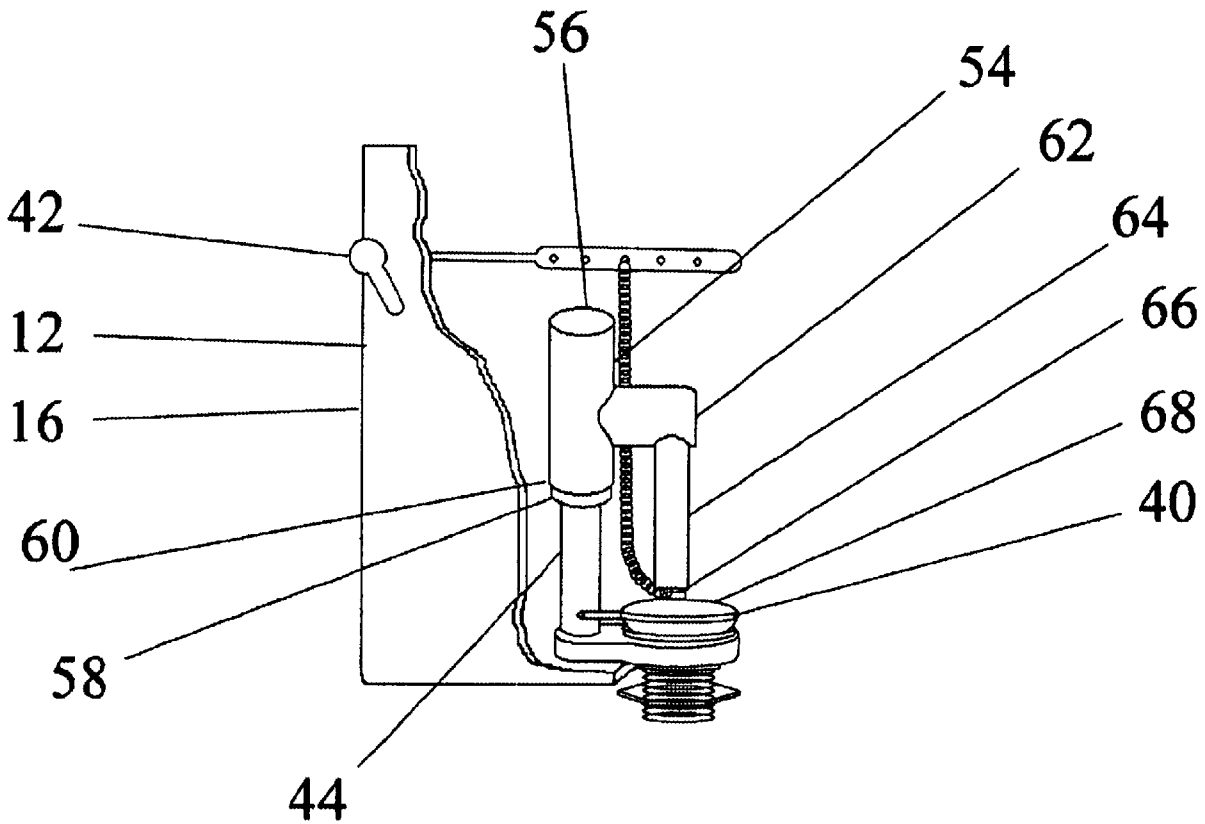
FIG. 4 is a partial cutaway view of one embodiment of a seal device positioned on the vent tube according to the invention.

FIG. 4 illustrates the interior portion of the tank 16 also including a sealing device 54 for use with the invention. The sealing device 54 comprises a support portion 56 slidably engaged to the upper portion 52 of the vent tube 44. The support portion 56 covers the opening 50 and a sealing surface 58 on the support portion 56 creates a substantially airtight seal around the opening 50. As shown, the sealing surface 58 is positioned on a lower rim 60 of the support portion 56, however, the sealing surface 58 can be placed on an interior surface of the support portion 56 such that a substantially airtight seal is formed around the opening 50 in the vent tube 44. In one embodiment the sealing surface is a strip of resilient material, such as a closed cell foam, rubber and the like.

The sealing device 54 also includes an arm guide 62 with an arm 64 extending therefrom. The arm 64 is configured so that a tip 66 thereof contacts a surface 68 of the flapper valve 40 so as to prevent the flapper valve 40 from unseating off the orifice 48. The tip 66 can have a stopper attached thereto so that firm contact can be made with the flapper valve 40 without damaging the flapper valve 40. Preferably, the support portion 56 is configured as a tube with an interior diameter larger than the outer diameter of the vent tube 44 so that the support portion 56 can slide onto the vent tube 44 until the tip 66 on the downwardly extending arm 64 contacts the flapper valve 40. Alternately, the arm 64 can have an extendable or telescoping portion (not shown) allowing the tip to be positioned adjacent the flapper valve 40, or the arm 64 can be repositionable in the arm guide 62, such as with a thumb screw, so that the tip 66 can be positioned in contact with the flapper valve 40.

In use, the sealing device 54 substantially prevents air from escaping from the toilet bowl 18 through the flapper valve 40 or through the vent tube 44 when using the clog removing system 10 to dislodge the clog. It is desirable that the force generated by depressing the clog removing system 10 is directed against the clog in order to push the clog through the restricted area. However, a flow path through the flapper valve 40 or vent tube 44 could offer a path of less resistance and thus the pressure created by the clog removing system 10 could be relieved through the tank 16, thereby reducing the effectiveness of the clog removing system 10 for clearing the clog. The sealing device 54 is positioned in the tank 16 to discourage the pressure from being relieved through the tank 16. After the clog has been cleared, the sealing device 54 can be removed from off the vent tube 44 in order to permit normal operation of the flapper valve 40 and vent tube 44.

Figure 5:
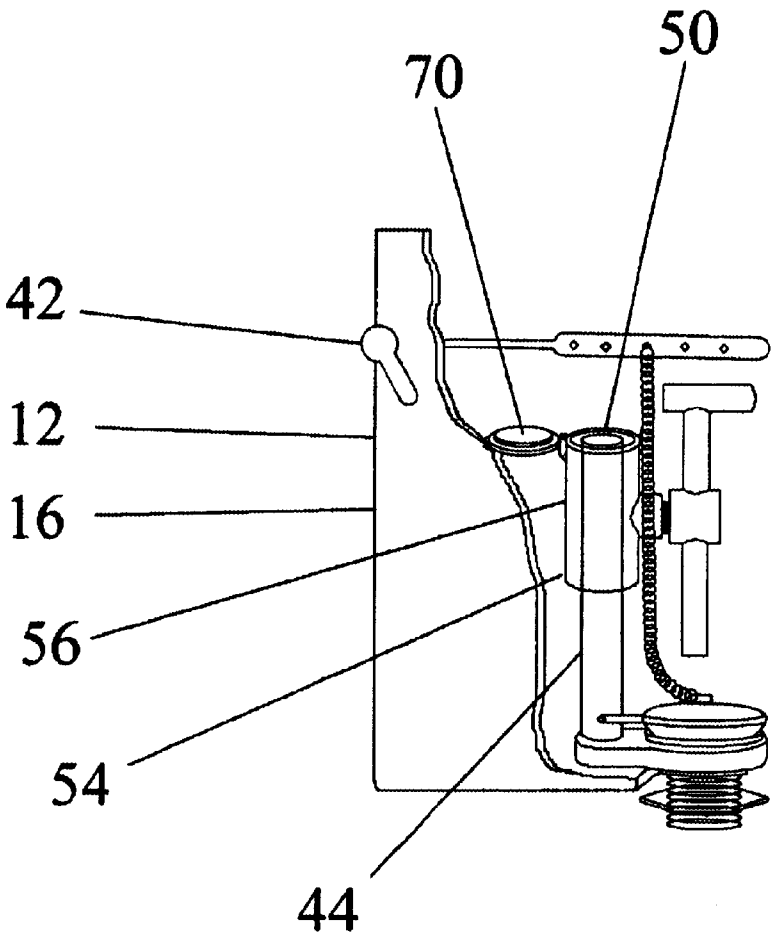
FIG. 5 is a partial cutaway view of another embodiment of a seal device positioned on the vent tube according to the invention.
Figure 6:
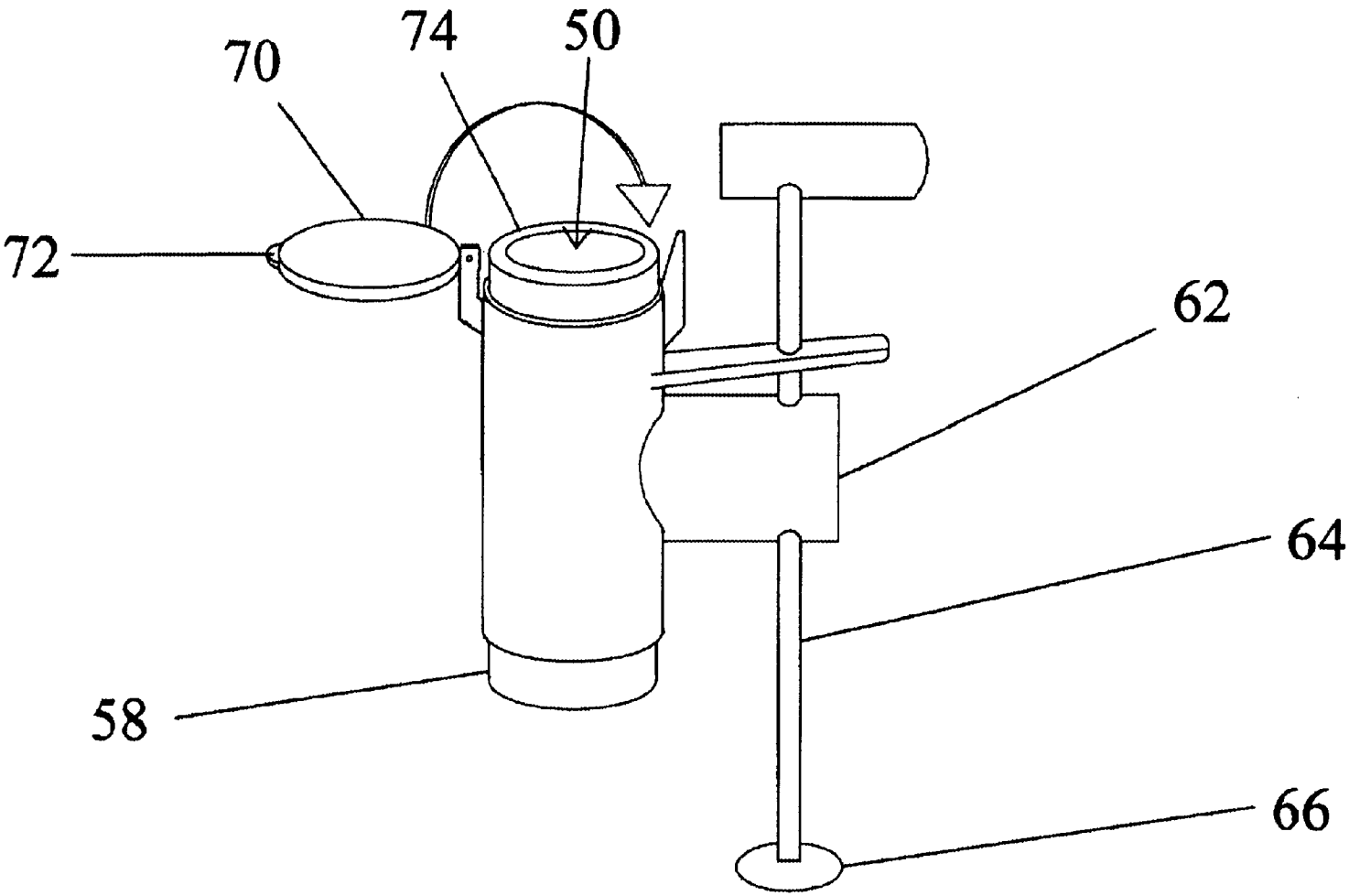
FIG. 6 is a perspective view of an embodiment of the seal device of FIG. 5.

FIG. 5 illustrates an alternate embodiment of a sealing device 54 that does not need to be removed from off the vent tube 44. The sealing device 54 can have a sealing lid 70 repositionable between a first position in which the vent tube opening 50 is unobstructed (as shown in FIG. 5) and a second position in which the lid 70 covers the vent tube opening 50. Preferably, as shown in FIG. 6, the lid 70 is configured with a latch 72 to secure the lid 70 in the second position so that a substantially airtight seal is formed. Other embodiments of providing a sealing device 54 that can be semi-permanently installed on the vent tube 44 are contemplated by this invention. For example, the Sealing device 54 can have a screw-on cap that can be removed from the support portion 56 for normal vent tube 44 operation or a cap permanently affixed to the support portion 56 that can be unscrewed to uncover slots in the support position permitting water flow into the vent tube 44.

Figure 7:
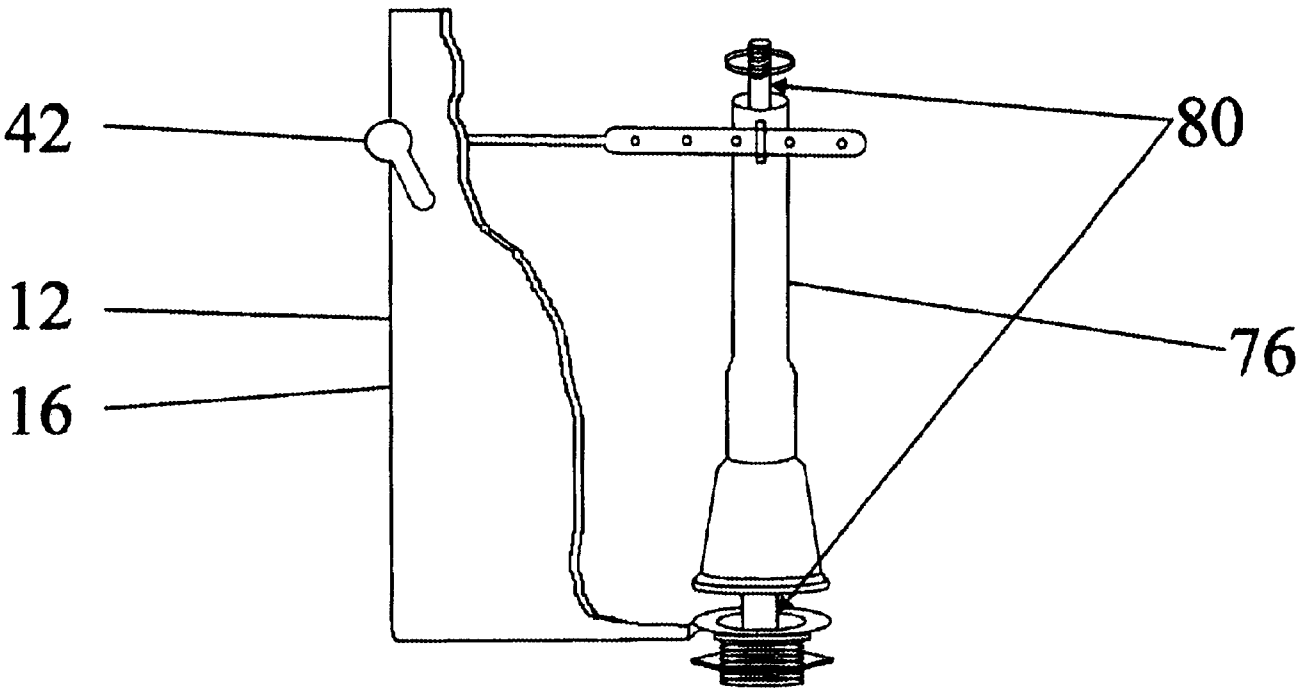
FIG. 7 is a partial cutaway view of a prior art toilet tank with a combination vent tube and flushing valve.
Figure 8:
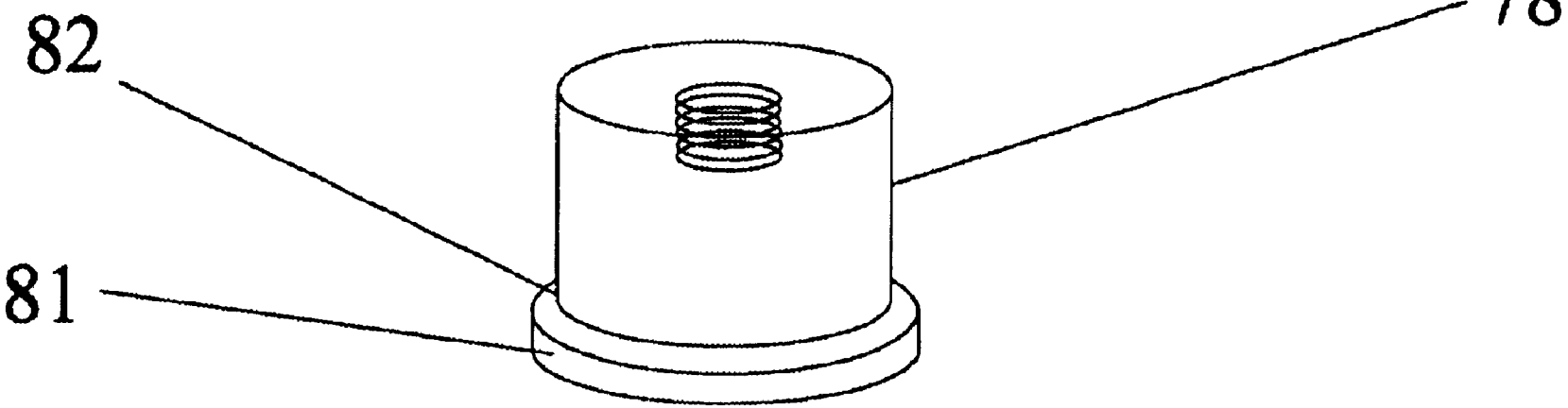
FIG. 8 is a partial cutaway view of another embodiment of a seal device positioned on the combination valve of FIG. 7.

FIGS. 7 and 8 illustrate an alternate embodiment of the sealing device 54 for use with a toilet tank 16 having a combination vent tube/flush valve 76. The combination vent tube/flush valve 76 is lifted when the handle 42 is depressed, thereby exposing the orifice 48 and permitting the flushing volume of water to be directed to the toilet bowl 18. In this embodiment, a cap 78 is threaded onto a center shaft 80 of the combination valve 76. The cap 78 includes a stopper (not shown) that substantially prevents the combination valve 76 from raising when the handle 42 is depressed. The cap 78 also has a sealing material 80 on a lower rim 82 thereof to create a substantially airtight seal over the vent tube 44. The cap 78 can be inserted onto the center shaft 80 when needed to clear a clog and removed for normal operation. Alternately, the cap 78 can be configured so that it can be unscrewed enough to allow normal operation of the combination valve 76 while remaining on the center shaft 80.

Figure 9:
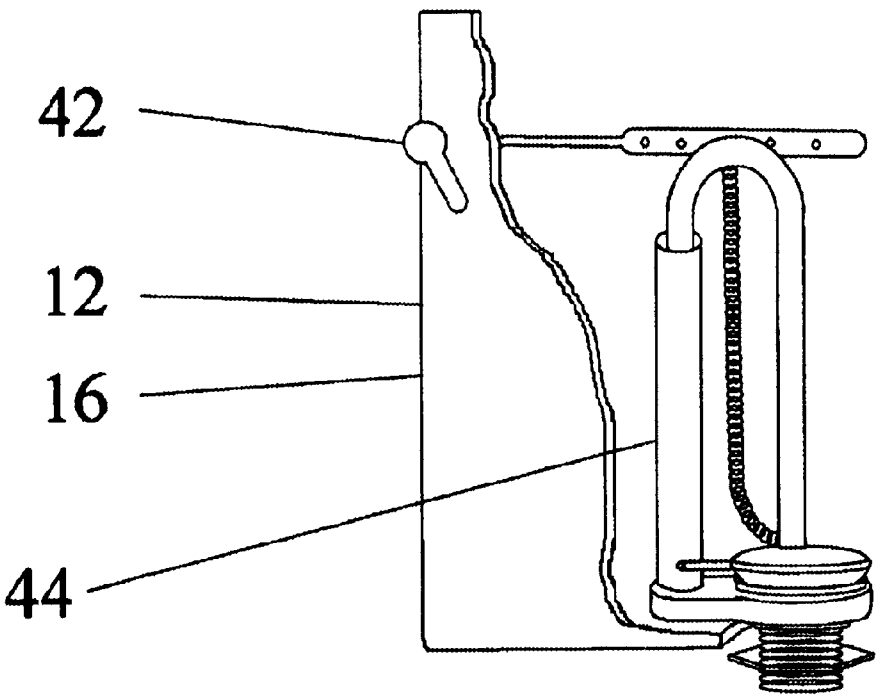
FIG. 9 is a partial cutaway view of another embodiment of a seal device positioned on the vent tube according to the invention.
Figure 10:
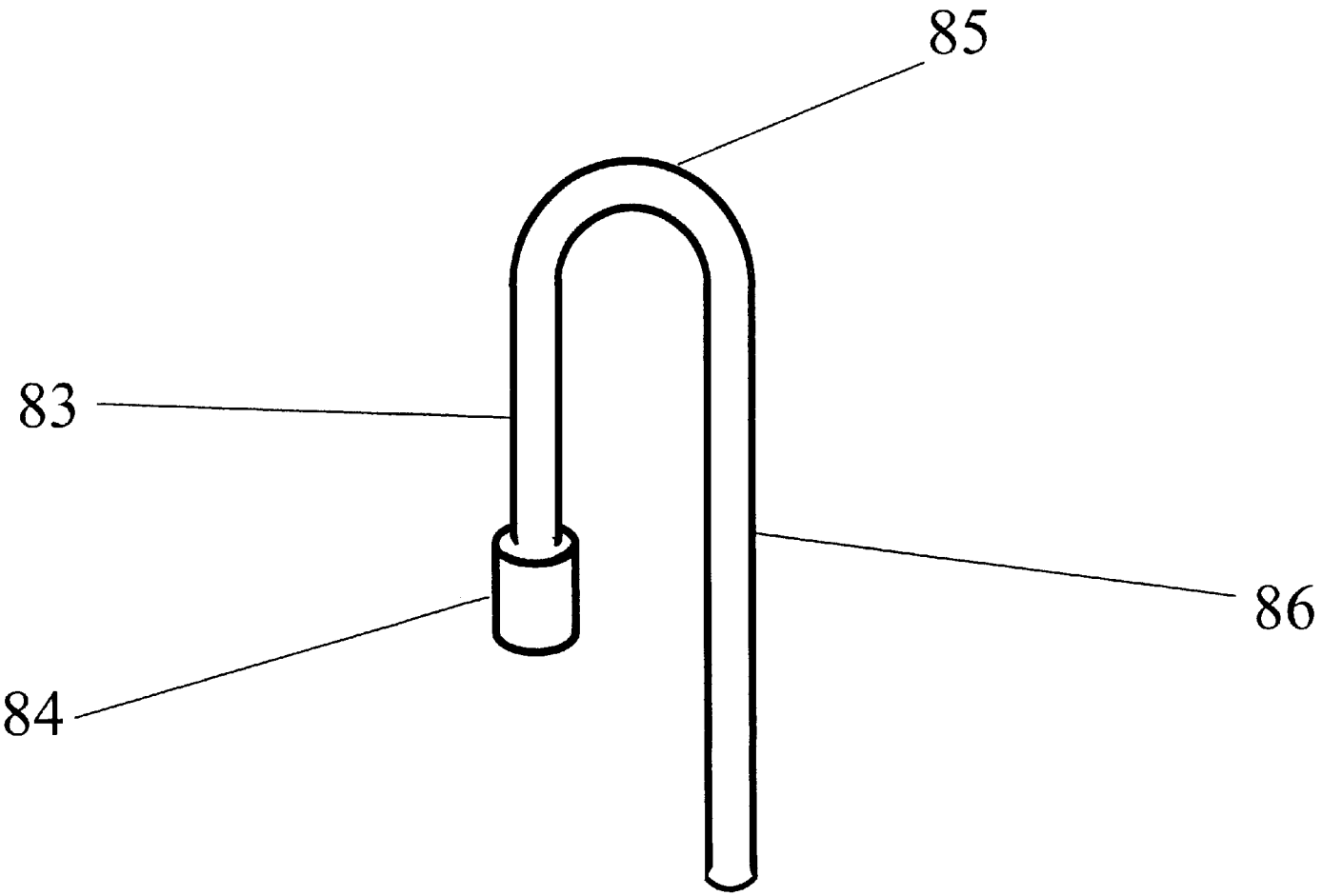
FIG. 10 is a perspective view of an embodiment of the seal device of FIG. 9.

FIGS. 9 and 10 illustrate an alternate embodiment of the sealing device 54 which works is substantially the same manner as described above except that a support portion 83 is positioned inside the vent tube 44. The sealing device similarly comprises a support portion 83 a sealing surface 84, and an arm guide 85 with an arm 86 extending therefrom.

Specific blocks, sections, devices, functions and modules have been set forth. However, a skilled technologist will recognize that there are many ways to partition the system of the present invention, and that there are many parts, components, modules or functions that may be substituted for those listed above. While the above detailed description has shown, described, and pointed out fundamental novel features of the invention as applied to various embodiments, it will be understood that various omissions and substitutions and changes in the form and details of the system illustrated may be made by those skilled in the art, without departing from the intent of the invention.

What is claimed is:

1. Apparatus for unclogging a toilet for use with a toilet being of the type having a bowl for containing flushable water therein, the bowl having a rim that is higher than the surface of the water with the bowl, and a tank in fluid communication with the bowl for storing a flushing supply of water, the tank having a valve mechanism for stopping the flow of water from the tank to the bowl until operated and a vent tube, the apparatus comprising:

a resilient sealing ring shaped generally to conform to the shape of the rim of the toilet;

a support plate attached to said sealing ring configured such that a force exerted on the support plate is transmitted to the sealing ring to compress the sealing ring against the rim of the toilet forming a substantially airtight seal around the bowl; and a sealing device insertable into the tank comprising a sealing surface configured to form a substantially air tight seal over the vent tube, said sealing device further comprising a member configured to mechanically block the operation of the valve such that air is substantially prevented from escaping from the bowl through the tank when the sealing ring is compressed.

2. Apparatus according to claim 1, wherein the resilient sealing ring is made from one of the group consisting of a closed cell foam, an open cell foam, rubber and plastic.

3. Apparatus according to claim 1, wherein the support plate is made of a rigid material.

4. Apparatus according to claim 1, wherein the sealing device comprises a support portion slidably engagable with the vent tube.

5. Apparatus according to claim 1, wherein the sealing surface comprises a strip of resilient material.

6. Apparatus according to claim 1, wherein the sealing surface comprises a repositionable lid.

7. Apparatus according to claim 1, wherein the member is an arm extending from the sealing device of sufficient length to contact a flapper valve of the toilet.

8. A sealing device for use with apparatus for unclogging a toilet for use with a toilet being of the type having a bowl for containing flushable water therein, the bowl having a rim that is higher than the surface of the water with the bowl, and a tank in fluid communication with the bowl for storing a flushing supply of water, the tank having a valve mechanism for stopping the flow of water from the tank to the bowl until operated and a vent tube, the sealing device comprising a device insertable into the tank comprising a sealing surface configured to form a substantially air tight seal over the vent tube, said sealing device further comprising a member configured to mechanically block the operation of the valve such that air is substantially prevented from escaping from the bowl through the tank when the apparatus compresses air against the water in the bowl.

9. Apparatus according to claim 8, wherein the sealing device comprises a support portion slidably engagable with the vent tube.

10. Apparatus according to claim 8, wherein the sealing surface comprises a strip of resilient material.

11. Apparatus according to claim 8, wherein the sealing surface comprises a repositionable lid.

12. Apparatus according to claim 8, wherein the member is an arm extending from the sealing device of sufficient length to contact a flapper valve of the toilet.

13. Apparatus for unclogging a toilet for use with a toilet being of the type having a bowl for containing flushable water therein, the bowl having a rim that is higher than the surface of the water with the bowl and a tank in fluid communication with the bowl for storing a flushing supply of water, the tank having a valve mechanism for stopping the flow of water from the tank to the bowl until operated and a vent tube, the apparatus comprising:

resilient sealing means for establishing an air tight chamber around the bowl and for changing the volume of air in the chamber within the air tight seal; and blocking means insertable into the tank for forming a substantially air tight seal over the vent tube and for blocking the operation of the valve such that air is substantially prevented from escaping from the chamber through the tank when changing the volume of air in the chamber.

* * * * *